US007641127B2

(12) United States Patent
Markus

(10) Patent No.: US 7,641,127 B2
(45) Date of Patent: Jan. 5, 2010

(54) MAKING FIXED RAILWAY TRACK

(75) Inventor: Wolfgang Markus, Wesel (DE)

(73) Assignees: Hain, Uwe & Hain, Silke, Alpen (DE); LS Beratungsburo Lublow GmbH, Bonen (DE)

( * ) Notice: Subject to any disclaimer, the term of this patent is extended or adjusted under 35 U.S.C. 154(b) by 499 days.

(21) Appl. No.: 10/530,218

(22) PCT Filed: Sep. 10, 2003

(86) PCT No.: PCT/EP03/10027

§ 371 (c)(1),
(2), (4) Date: Sep. 29, 2005

(87) PCT Pub. No.: WO2004/031483

PCT Pub. Date: Apr. 15, 2004

(65) Prior Publication Data

US 2006/0124760 A1 Jun. 15, 2006

(30) Foreign Application Priority Data

Oct. 1, 2002 (DE) ..... 202 15 204 U

(51) Int. Cl.
*E01B 1/00* (2006.01)

(52) U.S. Cl. ..... 238/2; 238/7; 238/9; 238/25

(58) Field of Classification Search ..... 238/2, 238/3, 4, 5, 6, 7, 8, 9, 24, 25, 382, 283
See application file for complete search history.

(56) References Cited

U.S. PATENT DOCUMENTS

| | | | | | |
|---|---|---|---|---|---|
| 152,469 | A | * | 6/1874 | Dehuff | 238/51 |
| 964,190 | A | * | 7/1910 | Snelling | 238/25 |
| 1,116,446 | A | * | 11/1914 | Lamp | 238/25 |
| 1,118,251 | A | * | 11/1914 | Wilson | 238/2 |
| 1,606,309 | A | * | 11/1926 | Lundie | 238/298 |
| 1,979,642 | A | * | 11/1934 | Sahlberg | 52/250 |
| 3,300,140 | A | | 1/1967 | Moses | 238/25 |
| 3,361,351 | A | * | 1/1968 | Moses et al. | 238/25 |
| 3,756,507 | A | * | 9/1973 | Hanig et al. | 238/2 |
| 4,280,657 | A | | 7/1981 | Ramer | 238/267 |
| 6,342,287 | B1 | * | 1/2002 | Kaczmarek et al. | 428/156 |

FOREIGN PATENT DOCUMENTS

| | | | |
|---|---|---|---|
| DE | 8911400 | | 7/1990 |
| DE | 4027836 | | 3/1992 |
| JP | 2001214402 | * | 8/2001 |
| JP | 2001254301 | * | 9/2001 |

* cited by examiner

*Primary Examiner*—Mark T Le
(74) *Attorney, Agent, or Firm*—Andrew Wilford

(57) ABSTRACT

A track system is made by setting a longitudinally extending row of concrete high-pressure injection piles in grown soil and then positioning atop the piles a succession of sleeper frames each including a pair of longitudinally extending rigid concrete beams held together transversely by a rigid steel structure. A longitudinally extending body of concrete is then cast between the beams around the steel frame. Finally longitudinally extending rails are fastened atop the beams.

5 Claims, 8 Drawing Sheets

MAKING FIXED RAILWAY TRACK

CROSS REFERENCE TO RELATED APPLICATIONS

This application is the US national phase of PCT application PCT/EP2003/010027, filed 10 Sep. 2003, published 14 Apr. 2004 as WO 2004/031483, and claiming the priority of German patent application 20215204.9 itself filed 1 Oct. 2002, whose entire disclosures are herewith incorporated by reference.

FIELD OF THE INVENTION

The present invention relates to a new type of fixed track system for rail traffic and to a method of manufacture thereof.

BACKGROUND OF THE INVENTION

Higher and higher rail traffic speeds have led to progressively more problems associated with the conventional railway design with a ballasted track. In the high-speed railway networks of Germany and other European countries the conventional ballasted track as a long-established, tried-and-tested system has reached its physical limits and is no longer capable of meeting requirements such as minimal susceptibility to faults and low maintenance costs combined with close distance spacing and high track capacity and therefore has no long-term future.

As an alternative, in 1972 DB AG, scientific institutes and the construction industry developed the so-called fixed track construction style, "Rheda," which together with the construction style, "Züblin," has been approved as the standard track for high-speed sections of German Federal Railways since 1992. In fixed track systems, the track formation layer and the gravel ballast of the conventional ballasted track are replaced by a hydraulically bound subbase with an asphalt or concrete base course on top. The overall structure is regarded, and hence treated as a system—earthwork/concrete base course—that is to be statically dimensioned. In contrast to ballasted track, it is very rigid and computationally determinable. The basic idea in developing the fixed track is to guarantee a uniform resilient bedding for the track, this being achieved almost exclusively by resilient intermediate layers in the region of the rail fastening or by resilient sleeper support systems. As a result, even in the speed range above 200 km/h the track is supported uniformly and with lasting positional stability, which means that e.g. larger cambers and hence higher cornering speeds become possible but also that maintenance outlay is negligible compared to the conventional trackbed.

Fixed track systems are subdivided mainly into two construction styles or design principles: in the case of the first, concrete sleepers (also concrete-block and steel tie-bars) or support blocks are embedded in concrete and therefore connected to form a monolithic structure, the track grating having to be fitted and vibrated and/or bedded in with millimeter accuracy. Later, this was changed to mounting and anchoring the track gratings directly on an asphalt or concrete base plate, which in turn has to be done continuously with millimeter accuracy. This has the advantage—not provided by a monolithic style of construction—of enabling the exchange of the individual sleepers. Here, the individual suppliers of fixed track systems vary in terms of conceptions and detail solutions. There are currently seven selected systems being tested on an operating trial section between Mannheim and Karlsruhe, including systems without sleepers, where the rail has been fastened directly onto support points of the concrete base course.

While the fixed track system offers many incontestable advantages, it does of course also have drawbacks, some of them system-related. The main points of criticism are listed and explained below.

The Federal Audit Office has criticized the high cost of installing fixed track and pointed out that to break even financially with the conventional ballasted track a useful life of at least 60 years would have to be achieved. The counter-argument to this is that it is possible to eliminate measures such as screening, retamping and renovating old ballast sections that incur cost and disrupt rail traffic and therefore to increase the degree of utilization of the railways. Despite automation and prefabrication, it is impossible to push the cost of creating the existing conventional fixed track systems down to the level, or below the level, of ballasted track, although there are always attempts at optimization. The high capital outlay for creating fixed track systems is due to their more complex manufacture, which is also reflected in a much longer construction period. This arises from the need for very high accuracy when laying track gratings and/or installing base plates, the need for costly upgrading of the soil (except for tunnel construction), and the construction period interruptions entailed by hydraulically bound layers and troughs supported on and in one another. The fundamentally required preliminary work, referred to here as costly upgrading of the soil, specifically means an exchange of the soil to a depth of, at times, over 3.0 m and subsequent layer-by-layer incorporation and compaction of precisely mutually tuned functional base layers in order to achieve the requisite properties, such as elasticity, stability, load distribution, frost protection, drainage etc. This also means i.a. that the renovation and conversion of an existing double-tracked ballasted section to the fixed track system may be carried out normally only by totally closing both tracks owing to the dimensions and shape of the trench.

As the next specific problem, the increased emission of airborne noise caused by the rigid structure and the absence of noise absorption is cited in many sources. Measurements and calculations have resulted in an airborne noise level increase of at most 3 dB(A), which has led to the use of cost-intensive sound absorbers and other sound-absorbing measures at the surface and in the edge region of the fixed track.

As a final and not unimportant drawback of all previous fixed track systems, the limited adaptability of the rail fastening and rail position owing to the monolithic structure is cited. Because the rail fastening points are invariably fixed and the displaceability of the rails is therefore limited to a minimal value, thereby making it relatively impossible to modify or adapt the operating pattern, very high demands are placed on the planning and surveying and designing of the route and the rail track. In contrast to the ballasted construction style, therefore, both subsequent modifications of the rail position and minor alteration of the track route or enlargement of the camber as well as point installation etc., if they are possible at all, are possible only with an extremely high outlay.

In summary, it should be stressed that with the currently available fixed track systems high capital costs are incurred as a result of the following parameters:

- very high planning outlay also with regard to long-term operational planning,
- very high outlay for soil exchange according to requirements,
- very high surveying outlay simultaneously with execution of construction work, very high construction outlay owing to the need for extreme accuracy.

What is more, conversion of an existing, heavily used section is not possible these days because of the need for total closure of both tracks and the long construction period.

OBJECT OF THE INVENTION

The object of the invention is, in a departure from the previous fixed track systems of diverse manufacturers and suppliers, to translate the cost-effectiveness and simplicity of design as well as the flexibility with regard to modifications of the track- and operating pattern of the ballasted track design to the fixed track, while eliminating the previous drawbacks.

SUMMARY OF THE INVENTION

According to the invention this object is achieved in the initially described fixed track system in that it comprises a frame-like structure.

The subject of the invention is in particular a new type of fixed track system for rail traffic comprising preassembled trackway rail carriers of statically delimited length, which run parallel to the track and are mounted on reinforced concrete composite piles nailed down underground by high-pressure injections and which in the frame-like assembled and aligned state enclose a trough, which is provided at an assembly side with a foil as a bottom termination and which once filled with casting cement forms a longitudinally and transversely reinforced, joint-free, continuous plate as an upper railway.

It is moreover proposed that the sleeper frame 2 comprises two rail-parallel reinforced concrete prefabricated parts 3 of minimal manufacturing tolerance and of a finite, non-fixed length, that preassembled trackway rail carriers of statically delimited length extending parallel to the track are provided, that the trackway rail carriers are supported on reinforced concrete composite piles, which are nailed down underground by high-pressure injections, that the reinforced concrete prefabricated parts 3 in the frame-like assembled and aligned state form a trough provided at an assembly side with a foil as a bottom termination, that the trough is filled with casting concrete and forms a longitudinally and transversely reinforced, joint-free, continuous plate as an upper railway, that the reinforced concrete prefabricated parts 3 for the loads in the final state are manufactured pre-curved counter to the load camber, that the parallel-running reinforced concrete prefabricated parts 3 are the sleeper body, that the sleeper bodies in the form of reinforced concrete prefabricated parts 3 are held apart in the assembled state by steel structures 4, 10, that the sleeper bodies in the form of reinforced concrete prefabricated parts 3 are secured in position in the installed state by steel structures 4, 10, that the final fixing of the longitudinal sleeper frame 2 is achieved by filling the space between sleepers to a defined height with casting concrete 7 of an adequate ultimate strength, that for packing a high-early-strength casting concrete 7 of an adequate ultimate strength is used, that the casting concrete 7 is provided with an adequately dimensioned reinforcing steel insert 9, that for transmission of the dynamic loads an, in static terms, infinitely long plate is produced by means of the longitudinal filling with casting concrete 7 of adequate strength and an adequately dimensioned reinforcing steel insert 9, that the construction as a plate of infinite length dispenses with a costly soil exchange in the case of problematical subsoils, that owing to the vertical clearance between the bottom edge of the rail body 14 and the top edge of the casting concrete 7 between the sleeper bodies 3 there is adequate room for the subsequent installation of point systems, that fastening profiles 16 incorporated in the factory into the prefabricated part of the sleeper body 3 enable easy fastening of additional parts such as e.g. noise protection systems in the wheel region or additional systems such as points, that all of the fastening points 15 are accessible at all times and therefore easy to maintain, that the surface of the space filled with casting concrete 7 is constructed with an adequate slope to allow surface water to drain away, that as a possible upper layer a noise-absorbing concrete layer is applied onto the casting concrete body 7, that the casting concrete body 7 is sealed off in a downward direction from the frost protection layer 1 by means of a PE foil 5 of adequate strength, that the PE foil 5 acting as a seal against rising damp is connected imperviously to the sleeper bodies 3, that water is removed from the surface of the casting concrete body 7 situated between the reinforced concrete sleeper bodies 3 by means of a drainage system 8, which is integrated in the factory into the prefabricated part, that the longitudinal sleeper frame 2 as vertical and horizontal fixing is anchored on reinforced concrete piles 11, 12, which are nailed down underground by high-pressure injections, and steel supports 13, that the longitudinal sleeper frame 2 as vertical and horizontal fixing is anchored on steel-reinforced piles 11, 12, which are nailed down underground by high-pressure injections, and steel supports 13, that the anchoring piles 11, 12, 13 in terms of their anchoring direction are orientated to the principal loading directions, that by virtue of the anchoring on piles 11, 12 and steel supports 13 the adjustment of the sleeper body 3 as a track carrier may be carried out in the air without difficulty, that the adjustment of the sleeper body 3 need be effected only at the support points at greater intervals along the foundation piles 11, 12, 13, that by means of this method even difficult subsoils are bridgeable without a greater outlay, that the rail 14 is mounted by means of the conventional standard connecting means 15 on the new type of sleeper bodies 3 and anchored in a laterally displaceable manner in the fastening sections or profiles 16, which are embedded in concrete transversely of the rail position in the rail fastening spacing, that the rail body 14 rests on a ribbed plate, that the rail inclination is freely adjustable by means of the ribbed plate, that the rail body 14 is laterally displaceable on the ribbed plate 15 in the released state of the fastening means 15, that the rail 14 is acoustically isolated from the substructure 1 by means of a sound deadening mat 6 laid therebetween, that an adaptation to different gauges entails merely the appropriate variation of the steel structures 4, 10 but no variation of the reinforced concrete beam 3, that in the sleeper bodies 3 in the upper region transversely of the rail position are horizontal cylindrical openings, which were left open already during concreting and recur at regular intervals and also allow the subsequent installation of a point mechanism.

BRIEF DESCRIPTION OF THE DRAWING

An embodiment of the invention is illustrated in the drawings in which.

SPECIFIC DESCRIPTION

Figure 1:
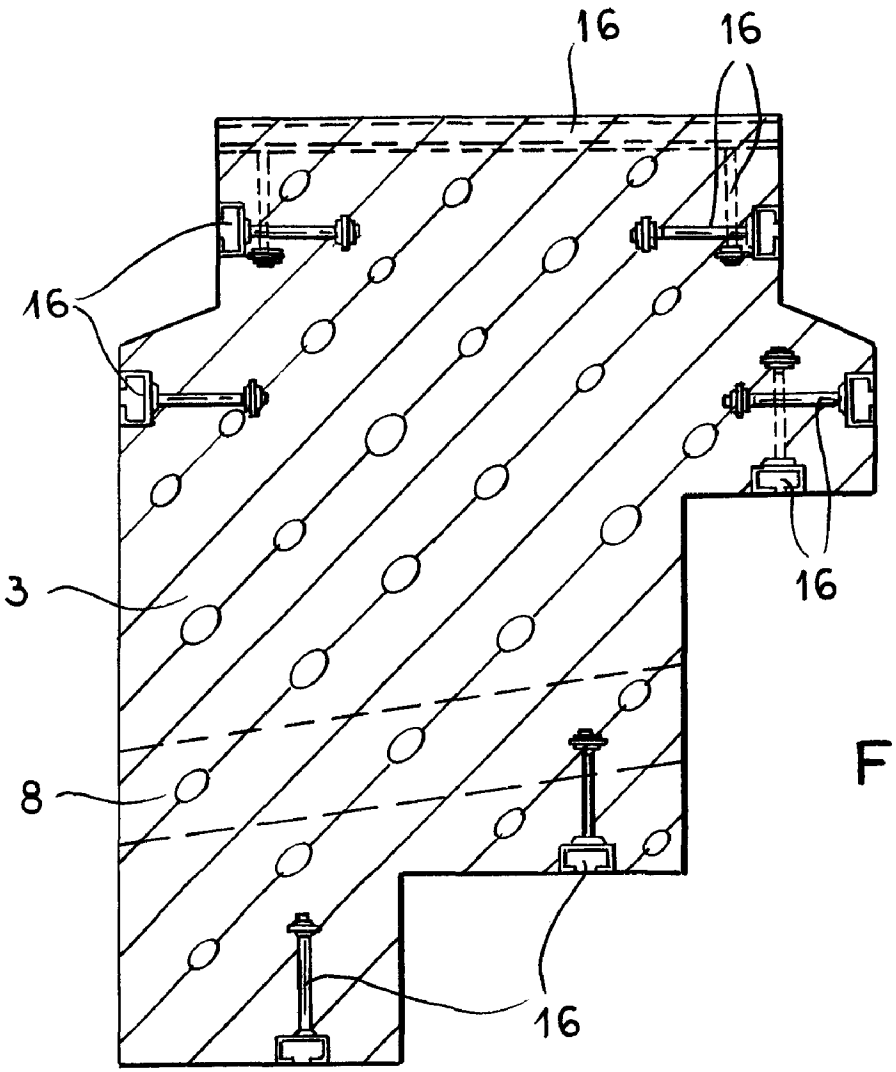
FIGS. 1-6 are cross sections showing the successive steps of making the track system of this invention.

FIG. 1 shows a cross section through the new type of reinforced concrete beam 3 in the form of a prefabricated part. It is possible to see the various fastening profiles 16, which are embedded in concrete mainly in beam direction over the length of the beam and of which the fastening profile embedded in concrete at the upper edge transversely of the beam is used to fasten the rail and recurs in the rail fastening spacing. It is moreover possible to see the passage prepared for the drainage pipes 8.

Figure 2:
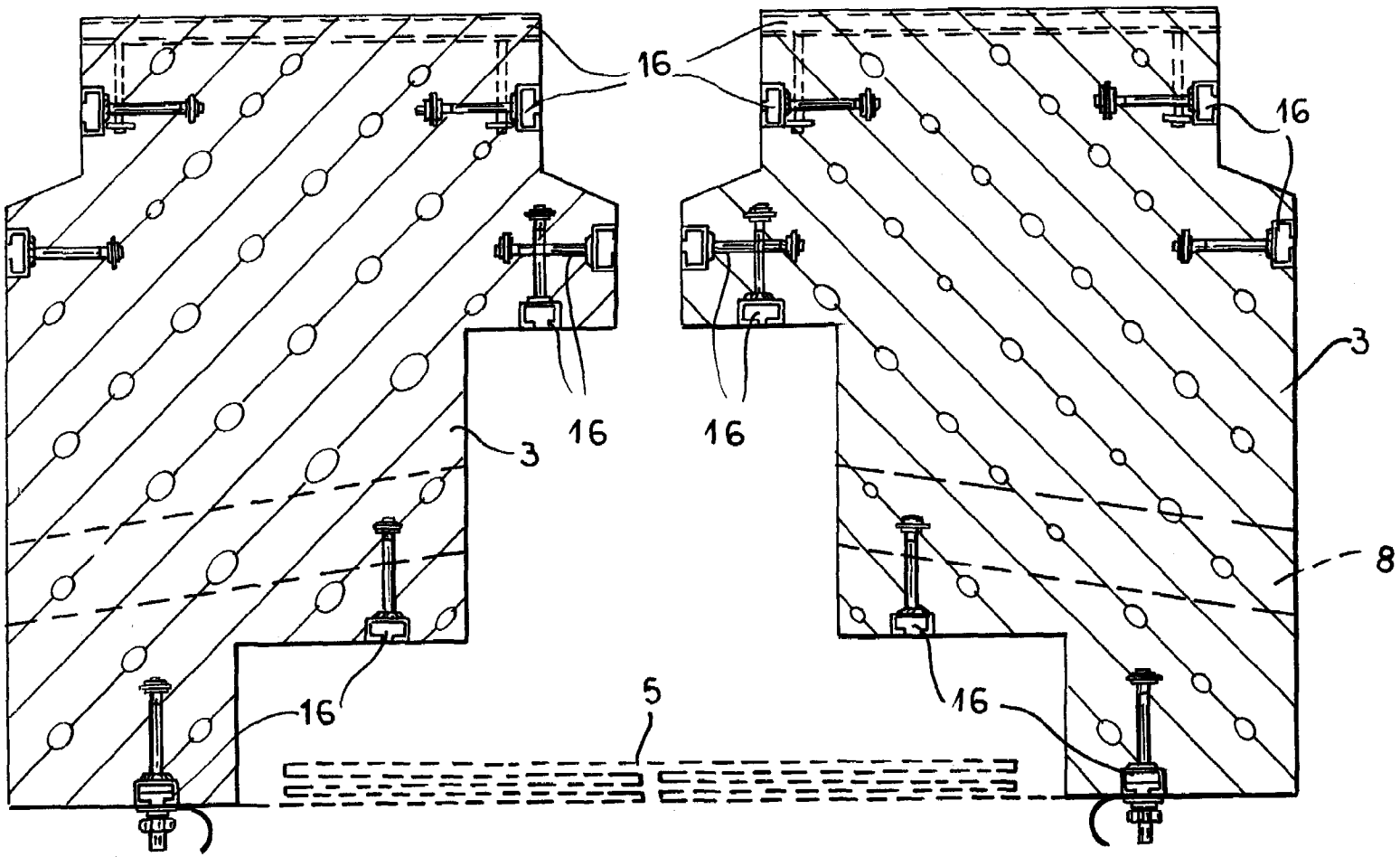

FIG. 2 shows in cross section a matching pair of the reinforced concrete beams 3 at the start of prefabrication of a longitudinal sleeper frame 2. The, in each case, bottom fastening profiles 16 in beam longitudinal direction have already been used for the impervious connection of the foil 5.

Figure 3:
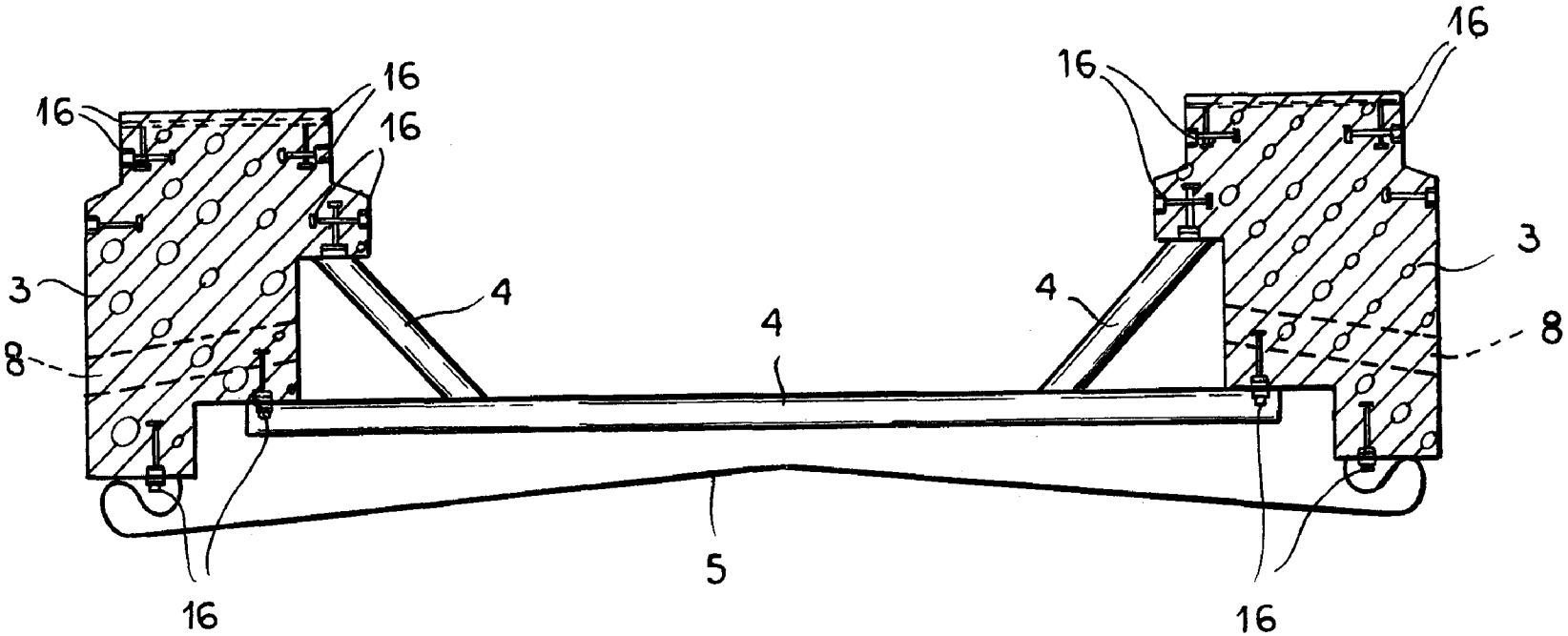

FIG. 3 shows in cross section a pair of reinforced concrete beams 3, the gauge of which has already been fixed by means of the bottom steel structure 4. The connection between beam 3 and steel structure 4 is effected likewise by means of the respective fastening profiles 16.

Figure 4:
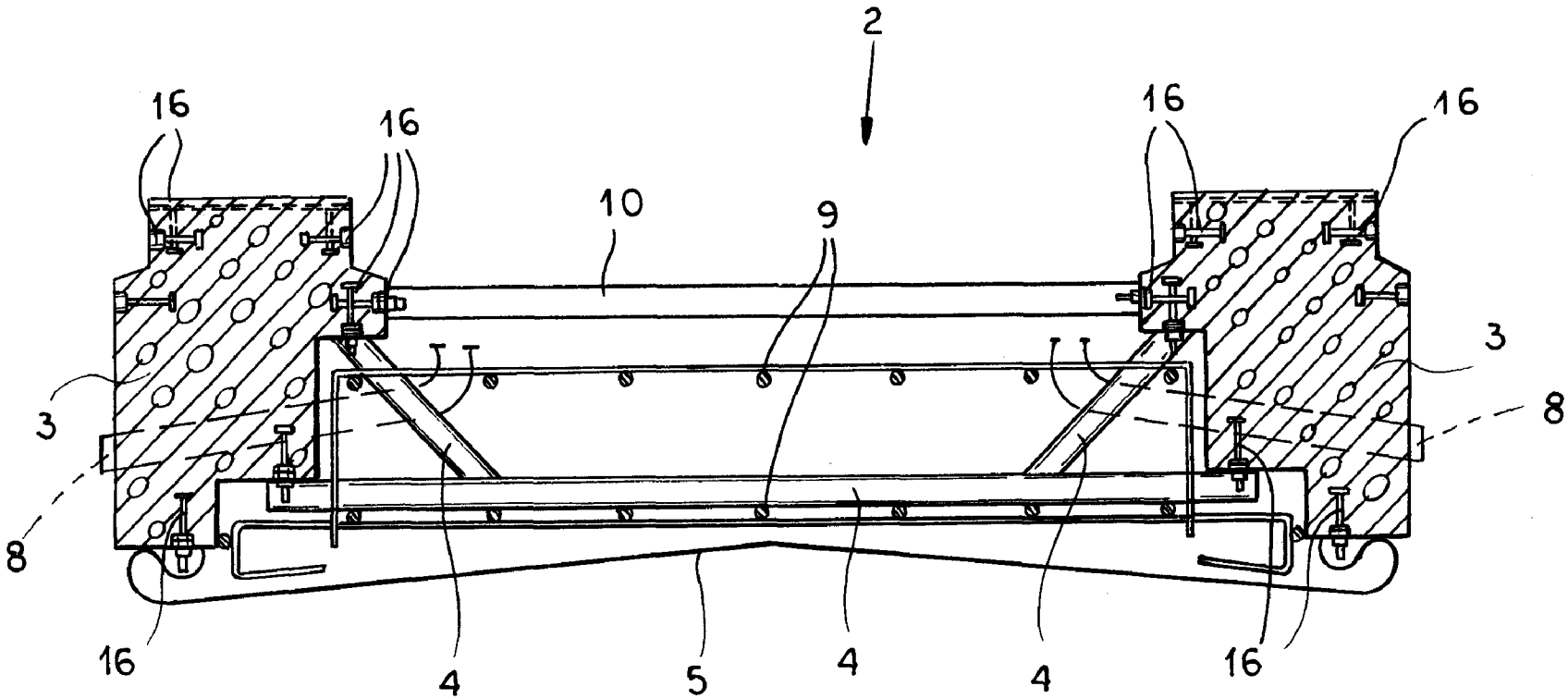

FIG. 4 shows a cross section through a fully preassembled longitudinal sleeper frame 2. By means of the fastening profiles 16, the transport- and concreting safety device 10 is connected non-positively to the pair of reinforced concrete beams 3 and the top and bottom longitudinal and transverse reinforcements 9 are fixed to the steel structure 4. The drainage pipes 8 have likewise been preassembled.

Figure 5:
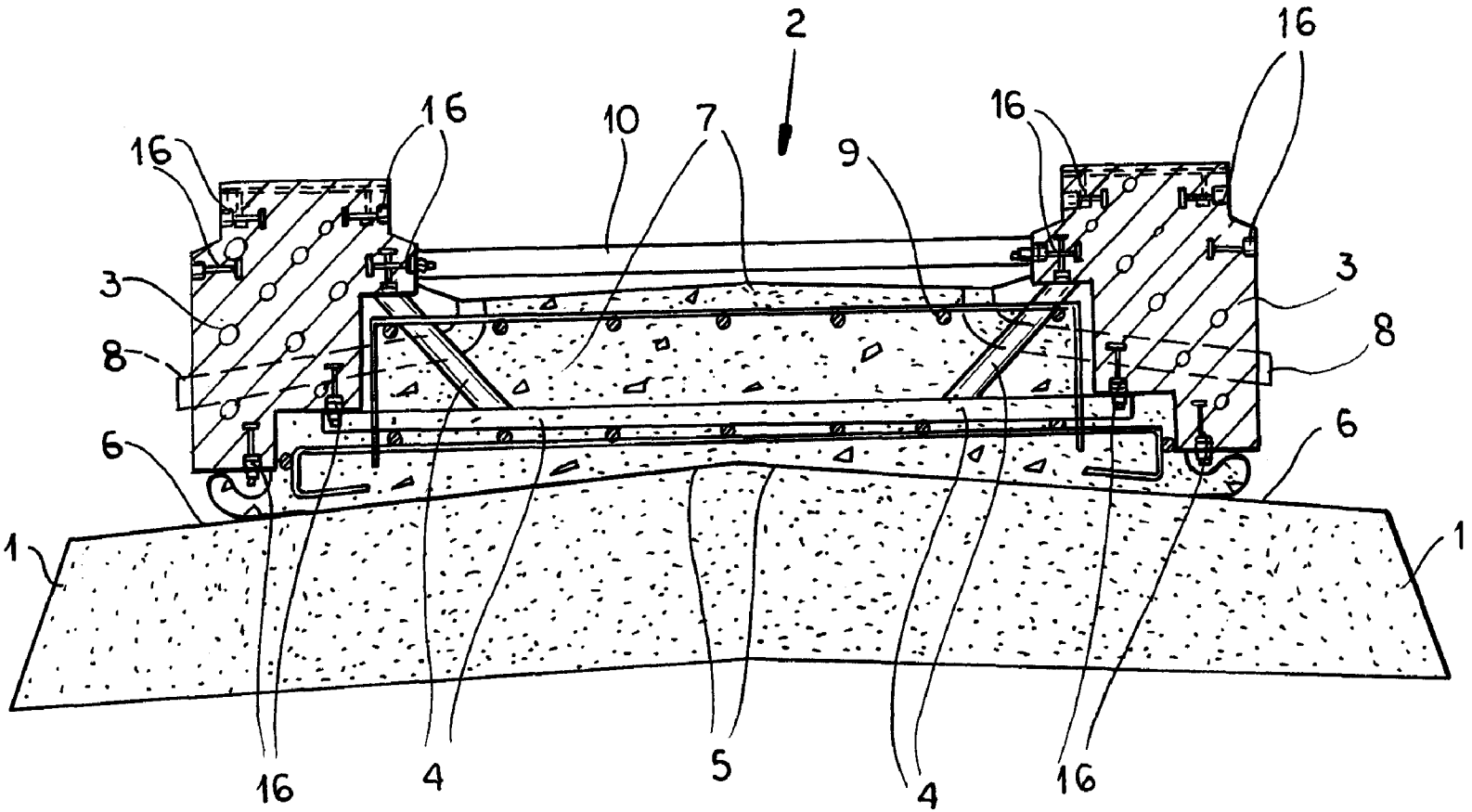

FIG. 5 shows a cross section through a longitudinal sleeper frame 2 assembled in situ. The sound deadening mat 6 is additionally situated between the foil 5 of the longitudinal sleeper frame 2 and the frost protection layer 1. The trough, which is formed by the pair of reinforced concrete beams 3 and the frost protection layer 1 and sealed off by the foil 5, is filled with casting concrete 7, which was introduced and compacted with a slight slope towards the inlets of the drainage pipes 8. After setting of this concrete, the transport- and concreting safety device may be removed and recycled.

Figure 6:
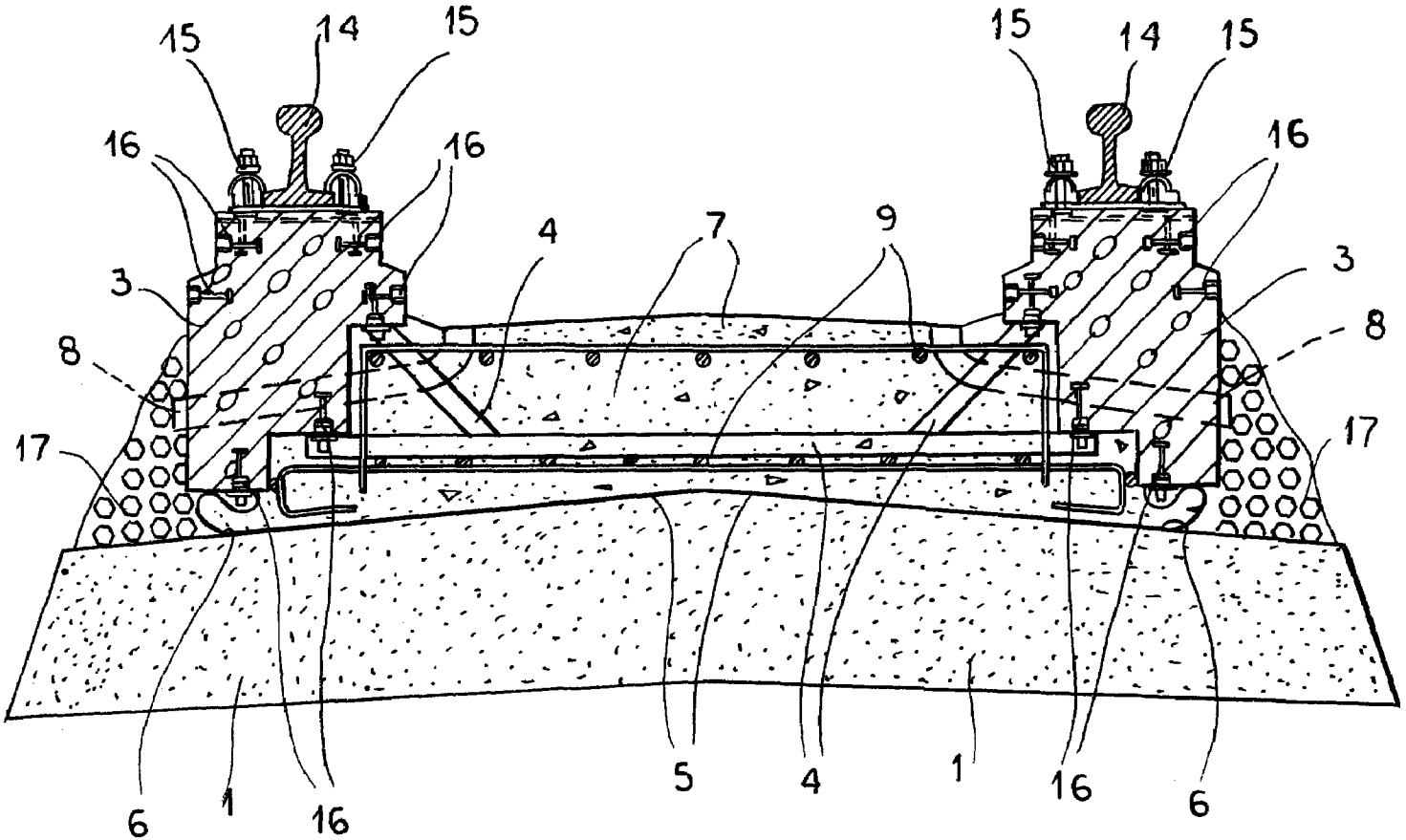

FIG. 6 shows a cross section through the ready-to-operate "new type of fixed track system for rail traffic". After removal of the transport- and concreting safety device 10, the rails 14 with rail fastening and rail support 15 are non-positively connected by the upper fastening profiles 16 to the longitudinal sleeper frame 2. At the outside of each of the reinforced concrete beams 3, gravel ballast 17 is introduced as a protective and filtering layer.

Figure 7:
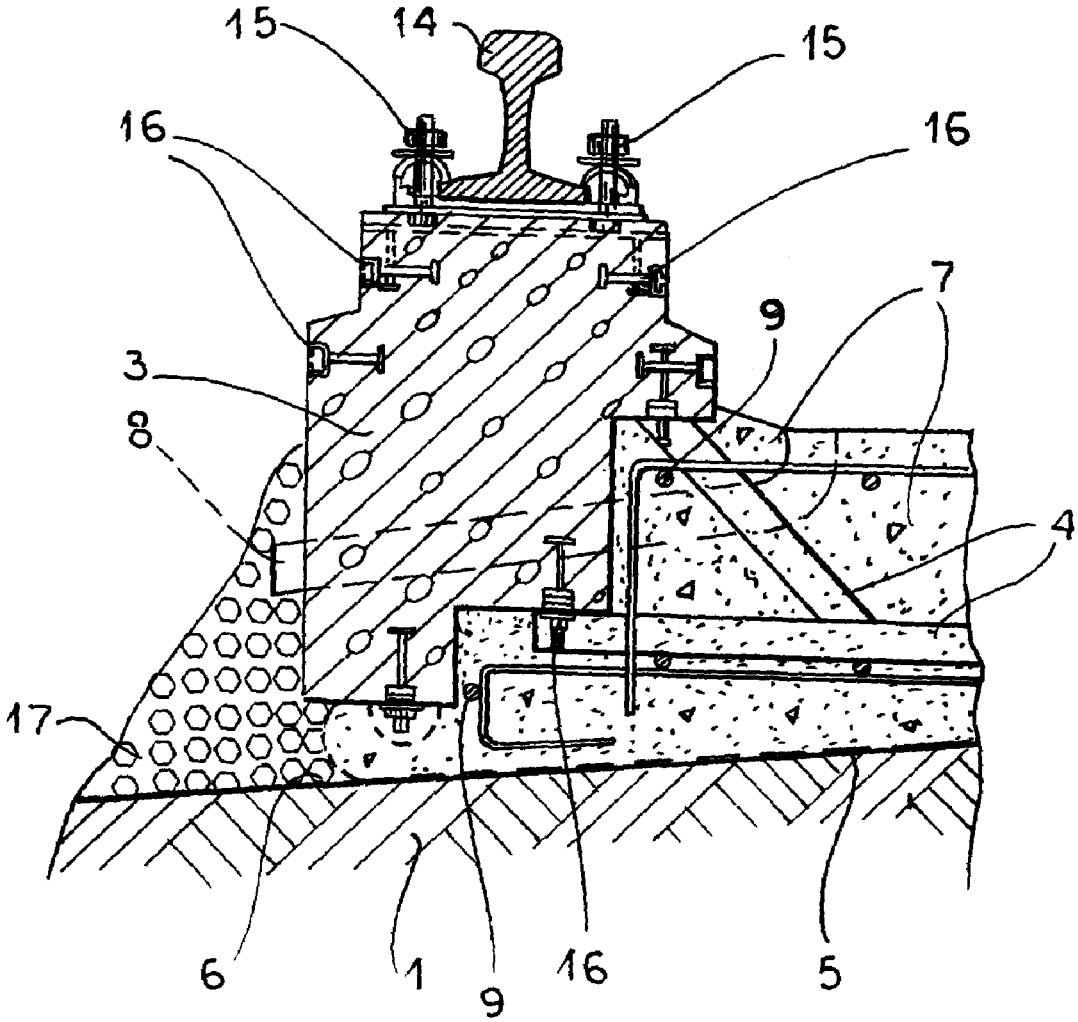
FIG. 7 is a large-scale view of the left-hand portion of FIG. 6.

FIG. 7 shows, for the sake of greater clarity, an enlarged detail from FIG. 6.

Figure 8:
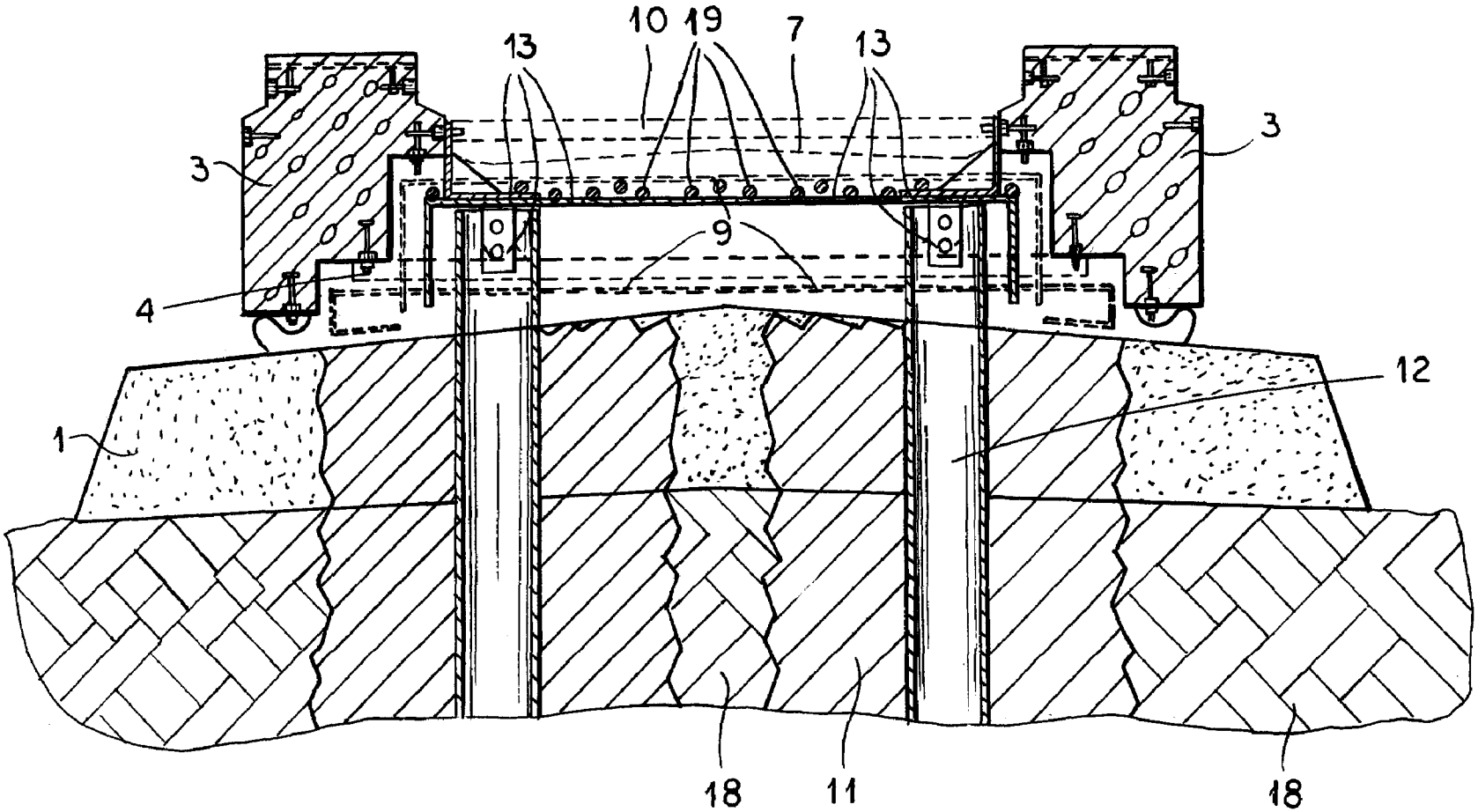
FIG. 8 is a view like FIG. 5 showing further details of the invention.

FIG. 8 shows a cross section through the support region of the longitudinal sleeper frame 2. It is possible to see the concrete high-pressure injection piles 11, that have been introduced in pairs into the grown soil 18, and the vertical steel girders 12 fixed therein and the finely adjustable steel supports 13 situated thereon. Before introduction of the casting concrete 7, the longitudinal sleeper frame(s) are connected non-positively and in a precisely positioned manner by the inner fastening profiles 16 to the steel support 13. Incorporated in the support region is an additional pillar reinforcement 19.

According to the invention, negative aspects of the fixed track, such as e.g. the extremely costly soil exchange, become redundant. Instead of, as before, having to completely exchange the existing soil at times to a depth of 3.0 m, an adequately dimensioned (max. 80 cm) frost protection layer 1 is sufficient as a protective and base layer on the grown soil 18. This renders the system suitable also for existing soils that have very poor and poor load-bearing capacity properties.

By virtue of extensive prefabrication of the longitudinal sleeper frame 2 comprising the reinforced concrete beams 3, the steel structure 4 as well as a transport- and concreting safety device in the form of steel structure 10, a substantial amount of cost and time is saved and so rail sections may be retrofitted or renovated occasionally without traffic interruption, during the night or with minimal restrictions up to 400 m in a shift are theoretically possible.

The reinforced concrete beams 3 are industrially prefabricated with maximum dimensional accuracy and minimum quality variations. Furthermore, the two matching parallel beams 3 are assembled by means of the connecting and bracing steel structures 4, 10 to the required linear measure, which is also still transportable, and provided with a foil 5 that is to be applied to the underside. In the installed state, this foil 5 together with a sound deadening mat 6 for acoustic isolation of track body and substructure forms the bottom termination relative to the frost protection layer 1 and prevents an escape of casting concrete 7.

Simply by suitably varying the dimension of the steel structures 4, 10 transversely of the rail position 14, any desired variation of the gauge of the finished track may be achieved without modifying the reinforced concrete beams 3.

Prefabrication likewise includes the provision of drainage by means of drainage pipes 8, which are run through the beam 3 and by means of which retained water situated between the beams is carried from there to the exterior of the overall structure.

Already at the preassembly stage, moreover, the top and bottom longitudinal and transverse reinforcement 9 is inserted and fixed in position by means of the above-mentioned steel structure 4.

Above the reinforcement 9 and the casting concrete 7 that is to be incorporated later, a further recyclable, adequately dimensioned steel structure is installed as transport- and concreting safety device 10.

The actual static fastening is effected by means of concrete piles 11, which are inserted in pairs using high-pressure injection and in which steel girders 12 are introduced, or by means of conventional large-diameter bored piles made of reinforced concrete, onto which a steel support 13 is fitted transversely of the subsequent rail position 14. After precise adjustment of this support 13 in height, longitudinal direction and transverse direction, the preassembled longitudinal sleeper frame 2 is laid on, aligned and fastened. The static and dynamic forces that arise are diverted via the composite piles 11, 12 and the steel support 13. This foundation work need be laid only ca. every 10 running meters, with the result that high surveying and leveling outlay prevalent with old systems to a large extent no longer applies. These injection piles 11, 12 may moreover be introduced with relatively low precision requirements in an existing section e.g. during the night break, so that setting of the concrete may occur under operating conditions. The exact alignment is effected, as described above, by means of the steel support 13.

The hollow space (concreting trough) formed by the pre-assembled reinforced concrete beam structure forminq the sleeper frame 2 is first lined with additional reinforcement 19 in the support region and then filled with casting concrete 7, carefully compacted, leveled and provided with an adequate slope for surface water to run in the direction of the drainage pipes 8. For this purpose, high-early-strength concrete should be used. From a static viewpoint, this longitudinal filling with concrete produces an infinitely long plate having excellent properties with regard to the diversion of dynamic forces from acceleration, deceleration and other dynamic forces arising from movement of the rail traffic. Filling the space between sleepers moreover allows optimum contact with the subsoil (frost protection layer) 1.

After hardening of the casting concrete 7, the transport- and concreting safety device 10 is removed.

The rails 14 are then mounted, not as before on a track grating of individual sleepers or concrete-block and steel tie-bars disposed at right angles, but on the two parallel-running, statically adequately dimensioned and e.g. pre-stressed reinforced concrete beams 3 of variable length by means of the conventional connecting means 15. It is therefore possible, here, fully to exhaust the maximum cut-up rail length of 360 m. Here too, the rail inclination is produced, as usual, by means of a standard ribbed plate 15. All of these rail fastening points 15 are later accessible at all times.

By virtue of fastening profiles 16 at the inside and outside of both beams 3 that have previously been simultaneously embedded in the reinforced concrete longitudinal sleepers 3 during the prefabrication phase, a subsequent fixed provision of noise protection measures or point constructions is easily possible. These are then just as easy to remove, shift to a different position or exchange.

A gravel layer 17 may be installed laterally of the finished track bodies and between the track bodies of a multi-track section.

Thus, the direct advantages of the invention, namely a new type of fixed track system, lie above all in the lower construction costs, the high installation speed, the relative independence from the subsoil and the subsequent variability of the track pattern.

The invention claimed is:

1. A method of making a track system, the method comprising the steps of:

prefabricating a plurality of sleeper frames each including a pair of longitudinally extending rigid concrete beams held together transversely by a rigid steel structure;

introducing pairs of concrete piles into grown soil with steel girders fixed in the piles;

fixing transverse steel supports to the girders of the piles;

positioning and fastening the prefabricated sleeper frames on the steel supports;

casting a longitudinally extending body of concrete between the beams around the steel structure and around upper ends of the girders underneath the steel structure; and after hardening of the cast concrete, mounting longitudinally extending rails atop the beams.

2. The method defined in claim 1 wherein the sleeper frames are secured to the supports via their rigid steel structures.

3. The method defined in claim 1, further comprising the step of:

filling to each transverse side of the frame with ballast after positioning the sleeper frames atop the piles.

4. The method defined in claim 1, further comprising the steps before positioning the beams atop the piles of:

forming the longitudinal beams and providing each of them with fastening profiles; and securing the rigid steel structure to the profiles to transversely fixedly space the beams and create the frames.

5. The method defined in claim 4, further comprising the step after forming the beams but before 3 securing the structure to the profiles of:

securing underneath each pair of beams a respective flexible foil, the foil being stretched between the beams by spreading the beams apart prior to securing the structure to the profiles.

* * * * *

UNITED STATES PATENT AND TRADEMARK OFFICE

CERTIFICATE OF CORRECTION

PATENT NO. : 7,641,127 B2
APPLICATION NO. : 10/530218
DATED : January 5, 2010
INVENTOR(S) : Wolfgang Markus It is certified that error appears in the above-identified patent and that said Letters Patent is hereby corrected as shown below:

Title Page, Item (73) Assignee should read

-- Uwe Hain & Silke Hain, Alpen (DE);
LS Beratungsbüro Lublow GmbH, Bönen (DE)
Wolfgang Markus, Wesel (DE); --

Signed and Sealed this

Fourteenth Day of December, 2010

David J. Kappos

David J. Kappos
*Director of the United States Patent and Trademark Office*